US006235389B1

(12) United States Patent
Schwarz et al.

(10) Patent No.: US 6,235,389 B1
(45) Date of Patent: May 22, 2001

(54) POLYESTER FIBERS AND FILAMENTS AND METHOD FOR THEIR PRODUCTION

(75) Inventors: Raimund Schwarz, Tomils; Werner Stibal, Chur; Gustav Schütze, Trin, all of (CH)

(73) Assignee: Inventa-Fischer AG, Zurich (CH)

( * ) Notice: Subject to any disclaimer, the term of this patent is extended or adjusted under 35 U.S.C. 154(b) by 0 days.

(21) Appl. No.: 09/396,917

(22) Filed: Sep. 15, 1999

(30) Foreign Application Priority Data

Sep. 16, 1998 (DE) ..... 198 42 463
Jul. 27, 1999 (DE) ..... 199 35 145

(51) Int. Cl.[7] ..... D01F 6/00; D01F 6/62
(52) U.S. Cl. ..... 428/364; 428/395
(58) Field of Search ..... 428/364, 372, 428/373, 395

(56) References Cited

U.S. PATENT DOCUMENTS 4,070,531 * 1/1978 Schwarze et al. ..... 526/6
5,565,522 * 10/1996 Bohringer et al. ..... 525/176
5,660,804 * 8/1997 Ochi et al. ..... 428/373

* cited by examiner

*Primary Examiner*—N. Edwards
(74) *Attorney, Agent, or Firm*—Jiawei Huang; J C Patents

(57) ABSTRACT

The invention relates to fibers or filaments, consisting predominantly of polyethylene terephthalate as a fiber-forming polymer, that contain 0.1–4 wt %, relative to the fiber-forming polymer, of polymethyl methacrylate as another polymer, predominantly in the form of rod-shaped inclusions, whereby in the unoriented melt fibers under the spinneret, the mean lateral diameter of the rods is less than 800 nm and the polymethyl methacrylate has, a weight average molecular weight of between 20,000 and 200,000 g/mol, and whereby the spinning speed of the spun fibers in the production is up to 8000 m/min.

Furthermore, the invention relates to a method for the production of these novel polyester fibers and filaments.

7 Claims, 3 Drawing Sheets

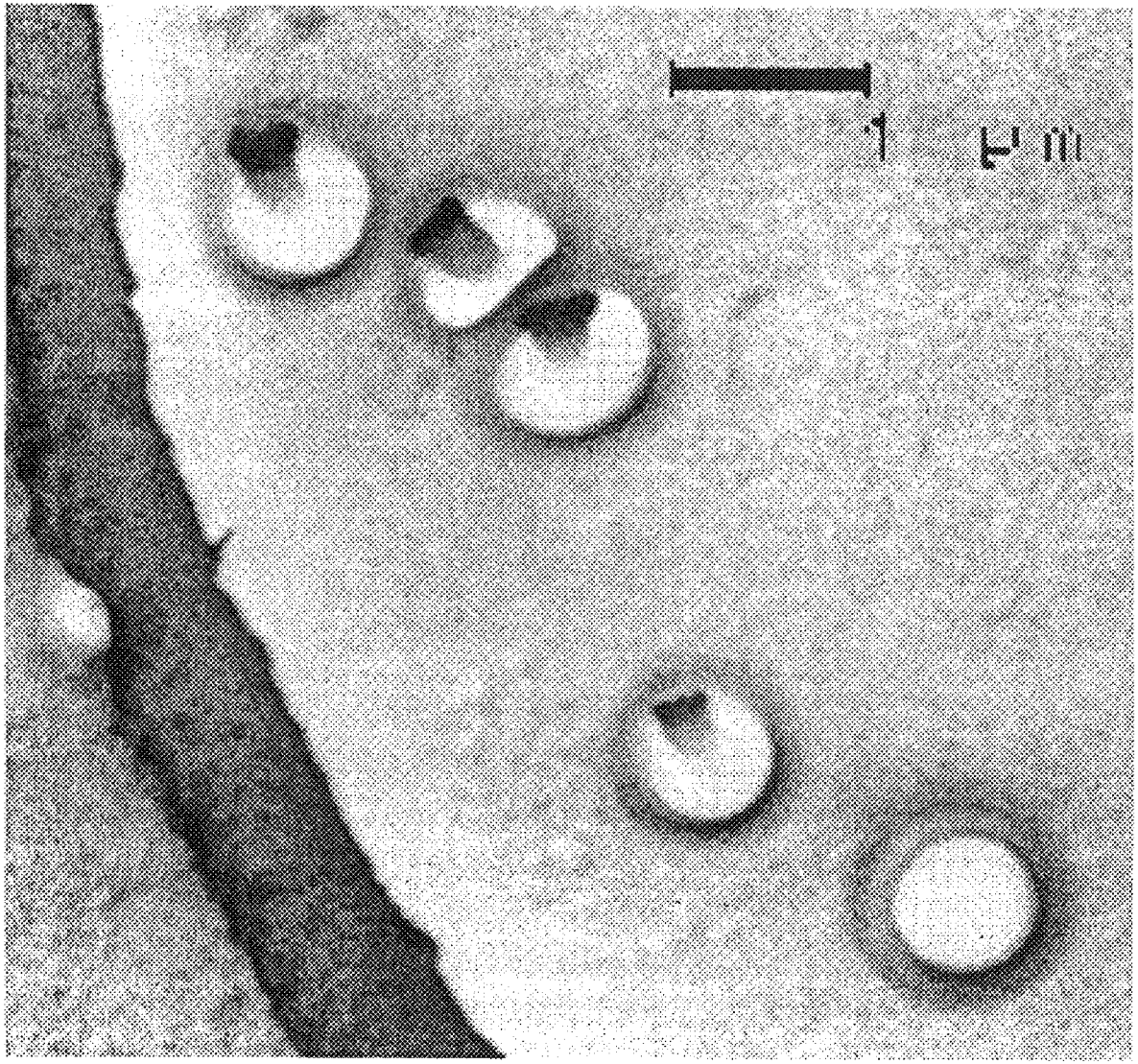
FIGUR 3

POLYESTER FIBERS AND FILAMENTS AND METHOD FOR THEIR PRODUCTION

BACKGROUND OF THE INVENTION

1. Field of Invention

The present invention relates to polyester fibers that contain a small amount of additives, and to a method for their production.

2. Description of the Related Art

It is known that fibers [or filaments] that contain small quantities of additives, depending on the composition of the mixture, can be processed by melt spinning, and sometimes, at the same spinning speed, can result in an increase in the elongation at break in the undrawn yam.

EP 0,047,464 B1 teaches that polymethyl methacrylate (abbreviated as PMMA hereafter) can be used in principle to increase the elongation at break at higher spinning rates.

This document describes the use of regranulated material, mixed in molten state, consisting of polyester with the addition of polymethyl methacrylate. This procedure is the optimum kind of premixing to achieve a homogenous product. However, as evidenced in EP 0,047,464 B1, when polymethyl methacrylates with high-molecular weights are used as additives, problems arise in the spinning process (see p. 5, lines 11–13).

EP 0,631,638 B1, like EP 0,047,464 B1, also describes the fact that polymethyl methacrylate has a limited capacity for spinning. EP 0,631,638 B1 describes a fiber polymer that contains from 0.1–5 wt %, relative to the fiber polymer, of a 50–90% imidized polymethacrylic acid alkyl ester, essentially in the form of inclusions. A significant disadvantage of imidized polymethacrylic acid alkyl ester additives, however, is the relatively high price of the additive. The costs of the imidized polymethacrylic acid alkyl ester show that a process that requires the named additive is not economical. Furthermore, the described additive cannot be obtained on a large scale and is also dependent on the few existing manufacturers. Another disadvantage is, as described above, that the spinning safety is limited. When this material is used as an additive, there are more often fiber breakages.

The maximum molecular weight of the polymethyl methacrylate described in EP 047,464 B1 is 16,000 g/mol (see p. 9, Table 5). Furthermore, in this document it is mentioned that, for PMMA drop diameters in the polyester matrix of more than 1 $\mu$m, the increase of elongation is no longer optimal. Otherwise, there is no further discussion of the morphology of the inclusions.

Normally, as also described in EP 0,047,464 B1 and in HP5, The Highly Economical POY Process for Polyester, Fiber Producer Conference, Greenville, 1998, "such incompatible inclusions appear in the unoriented polyester free fall yarn, that means, in the unoriented molten fibers extruded from the spinneret inclusions appear in the form of balls or drops. In EP 0,047,464 B1, it is stated on p. 4, lines 13–15, as well as on p. 5, lines 8 and 9, that the inclusions possibly (similar to a ball bearing) cause a "roll effect" in the fiber direction that leads to a delayed deformation of the polyester.

A possible association of special forms and sizes of additive inclusions in the still unoriented polyester free fall yam, with the special properties by respect to the end product required here and with the important spinning behavior essential for an industrially useful process, on the contrary, was not recognized.

SUMMARY OF THE INVENTION

The objective of the present invention, therefore, is to make available polymer mixtures for the production of polyester fibers that can be spun well and contain no more than 4 wt % additives, whereby the production method, due to the small additive quantity, should have a broad availability of the additive, and due to the great increase of the elongation at break, should be highly economical.

This objective is achieved by the fibers and the method according to the present invention.

In one aspect, the present invention provides fibers consisting predominantly of polyethylene terephthalate as a fiber-forming polymer, characterized in that the fibers contain 0.1–4 wt %, relative to the fiber-forming polymer, polymethyl methacrylate with a weight-averaged molecular weight of about between 20,000 and 200,000 g/mol, predominantly in the form of rod shaped inclusions, measured in a still-unoriented melt fiber free fall yarn extruded from a spinneret, whereby the cross-section of the rod shaped inclusions of the polymethyl methacrylate is less than 800 nm, and whereby the spinning speed of the spinning fiber in the production of the fibers is up to 8000 m/min.

In another aspect, the present invention provides a method for the production of melt-spun fibers comprising polyethylene terephthalate as a fiber-forming polymer, through polycondensation or melting of the fiber-forming polymer forming a melt and subsequently melt spinning. The method comprises mixing 0.1–4 wt %, relative to the fiber-forming polymer, of a second polymer consisting essentially of polymethyl methacrylate with an average molecular weight of about between 20,000 and 200,000 g/mol, with of the fiber-forming polymer before the melt spinning and dispersing the second polymer in the fiber-forming polymer forming unoriented melt fibers, and during the melt spinning, a spinning speed of the fibers is set at up to 8000 m/min, whereby through the inclusion in the unoriented melt fibers, extruded from a spinneret, [rod-shaped]rod shaped inclusions of the second polymer with a cross-section of less than 800 nm are obtained.

BRIEF DESCRIPTION OF THE DRAWINGS

FIGS. 1, 2, and 3 show REM cross-sectional images of a melt fiber in the matrix polymer (PET) according to the invention.

DETAILED DESCRIPTION OF PREFERRED EMBODIMENT

Surprisingly, it has been discovered by the inventors that fibers that can be produced from polymer mixtures of polyesters, especially polyethylene terephthalate (PET) and small additional quantities of polymethyl methacrylate (PMMA), can exhibit very high elongation at break, even at high spinning rates, and simultaneously show outstanding spinning behavior. Generally speaking, mixtures of polyesters, such as PET and polymethyl methacrylate mixtures, and the effect of polymethyl methacrylate in increasing the elongation are known, but also known is the tendency of fiber breakages in spinning of such mixtures. Such fiber breakages tend to occur, even more significantly, when polymethyl methacrylates with very high molecular weight are used.

Thus, it is described in EP 0,047,464 B1, as already mentioned, that although the increase of the polymethyl methacrylate molecular weight brings about an intensification of the effect of increasing the elongation, spinning problems also appear simultaneously. In other words, the effect of intensifying the increase of elongation at very high molecular weights of the polymethyl methacrylate as taught in the prior art can in no way be accepted, due to the associated tendency of increased fiber breakages. The economic feasibility of an industrial method based on the product described in EP 0,047,464 B1 is thus very limited.

Figure 1:
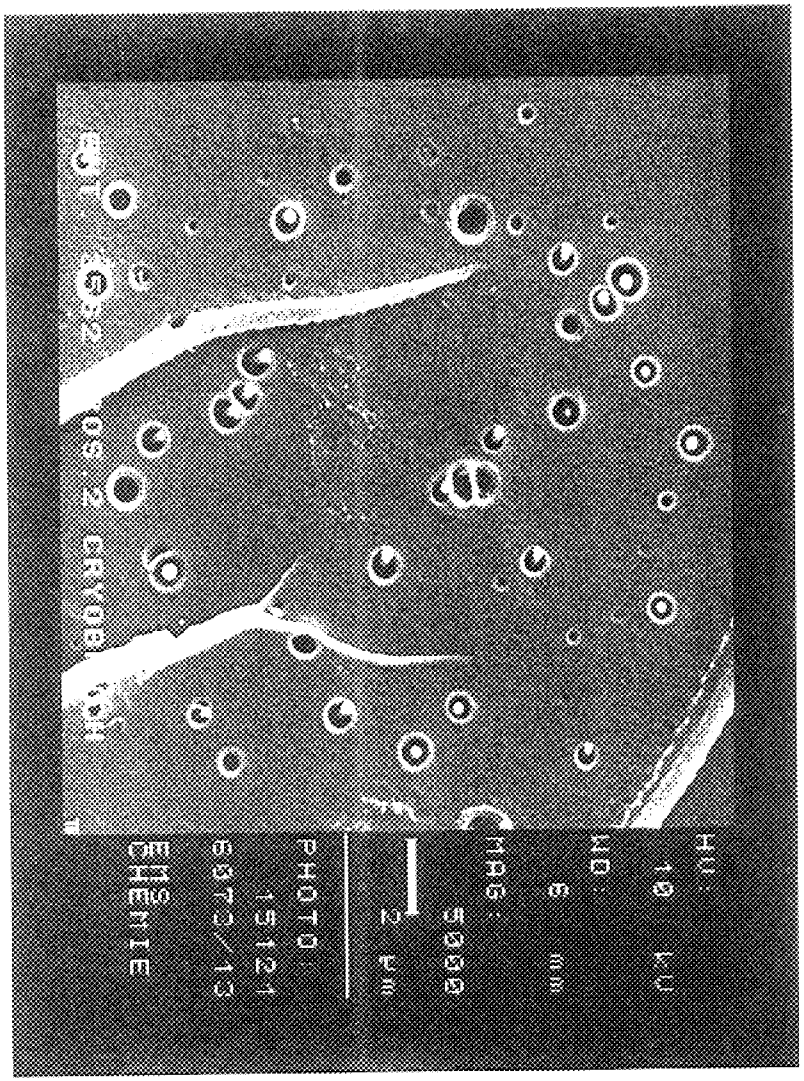
Figure 2:
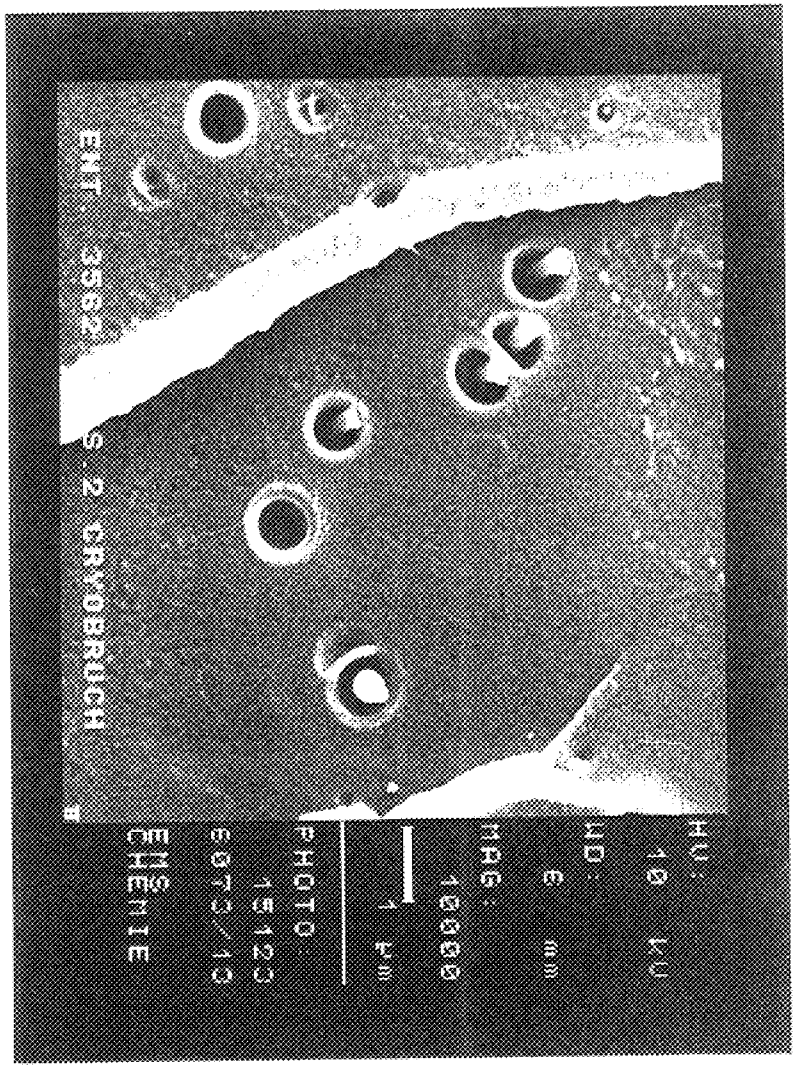

Surprisingly, it has been discovered by the inventors that in the present invention, the additives dispersed in the still unoriented polyester free fall yarn, do not have a drop-like or spherical shape as those described in EP 0,047,464 B1 and in "HP5, The Highly Economical POY Process for Polyester, Fiber Producer Conference, Greenville, 1998", but rather, as shown in FIGS. 1, 2, and 3, bring about a novel, rod shaped or worm like, stretched appearance. Therefore, the invention is based on the fact that precisely these new characteristic structures of the PMMA inclusions result in improved spinning capacity, and this is described, especially at very high polymethyl methacrylate molecular weights, as in the example according to the invention.

Also notable is that the lateral diameters of the new rod shaped structures are very small. The rod shaped inclusions represented in the example have, for example, a lateral diameter of approximately 300–400 nm, measured in the still-unoriented molten fibers extruded from the spinneret, the so-called free fall yam.

It is important that the diameter be smaller than 800 nm. Preferred is a size of less than 600 nm, and especially preferable is less than 400 nm.

However, the "rod shaped" structure of the polymethyl methacrylate inclusions in the still unoriented polyester matrix of the present invention has nothing in common with the observations that were described in EP 0,047,464 B1. The "rod shaped" structures found according to the present invention must, as always, obey a mechanism other than the principle described in EP 0,047,464 B1. Very likely, this is the reason for the better running behavior in the context of the present invention.

Thus, it is conceivable that drop-like or spherical inclusions in a polymer matrix have the effect of reducing orientation, also due to the expected molecular movements of the polyester matrix perpendicular to the direction of the fiber stretching, the spinning process is more or less disturbed.

In the case of the rod shaped inclusions found for the first time according to the invention, the spreading components of the polyester molecules crosswise the fiber should be reduced, which would explain the improvement in the spinning behavior.

The polymer mixture containing PMMA, used according to the invention, can also be spun at high spinning rates without any problems, such as using conventional cross-flow air quench.

However, other known cooling devices are also well-suited, such as devices for passive cooling by air suctioning of the quick-running fibers or air quencher that are arranged in the center of the fiber bundle.

In general, the present invention is suitable both for the production of partially oriented yams (POY) (as explained in the example), and for the production of fibers (such as staple fibers). In the latter case, the spinning is done at significantly slower speed, then is drawn much more intensely (as known to the technical expert from Ullmann's Encyclopedia of Industrial Chemistry, 5th Ed., Vol. A10, Fibers, 3. General Production Technology, pp. 550-561). The economic gain in the present invention is expressed, particularly in the case of the fiber development, in the significantly increased drawing ratio on the fiber production line, in addition to the correspondingly higher through-put with melt spinning.

In the production of fibers with the method of the present invention, a spinning speed in the range of 800–2400 m/min is preferably selected, and in the production of partially oriented fiber yams (POY), a spinning speed of 3000–8000 m/min, although the present invention is not limited to those spinning speeds.

As an additive, the commercially-available polymethyl methacrylate product, DEGALAN® of DEGUSSA Co., has proven advantageous. In spite of the high molecular weight of the DEGALAN® type G8E of about 126,580 g/mol (weight average molecular weight according to the measurement method described in the following), it has been found to be outstandingly suitable. Aside from an enormous increase of the elongation, the very high-molecular material also brings into the mixture with polyester a surprisingly outstanding spinnability at high spinning rates. Since the mixture containing the very high molecular weight DEGALAN® type G8E and polyethylene terephthalate (PET) can be spun excellently, it can also be assumed that the types of PMMA with a lower molecular weight (such as 20,000–120,000 g/mol) than the used would also lead to improved spinning behavior in comparison with the art.

Furthermore, in comparison to the additive component (polymethyl methacrylimide) described in EP 0,631,638 B1, polymethyl methacrylate is significantly cheaper and has good availability.

With reference to the effect of increasing elongation, polymethyl methacrylate molecular weights (weight average) between 20,000 and 200,000 g/mol according to the invention are suitable. Preferred are molecular weights between 50,000 and 160,000 g/mol. Particularly preferred are molecular weights between 80,000 and 140,000 g/mol.

The data on the molecular weight of PMMA relate to the following measurement method (internal analysis directions No. LC 012 of EMS CHEMIE AG):

The distribution of the molecular weight and the weight average ($M_W$) of the mole mass of PMMA are determined by means of gel permeation chromatography (GPC), that is, with a GPC measurement device with the base apparatus component pump, chromatography columns, and detector known for liquid chromatography. For the measurements, a device of the Waters Co., type GPC 150C with RI detector is used. As columns, the four individual column measuring 250 mm×7 mm (diameter) are connected one behind the other in a series to form a total column length of 1 m. The columns are filled with MERCK LiChrogel® 10 $\mu$m, in the combination PS4000, PS400, PS20, and PS4 (indicating the pore size) for the four individual sections so that each fraction of molecular weight of the PMMA is separated optimally. Chloroform is used as the stock solution for the PMMA samples, with 0.1% 1,2-dichlorobenzene as the flow marker. Chloroform is used as the eluent in a flow rate of 1 ml/min. To prepare the samples, 50 mg of each sample of PMMA is weighed into a sealable 20-mL glass, filled to the mark with stock solution, and agitated until complete dissolution. At first, at least 5 PMMA standards are also prepared in exactly the same manner, from the range $5{,}720<M_W<360{,}000$ g/mol that were weighed by the POLYMER LABORATORIES Co. The measurement of the molecular weight is calibrated with the standards. The injection volume of the sample solutions is 200 $\mu$l in each case. All temperature adjustments are to 30° C. The assessment of the measurements (chromatogram) is made using the GPC software, MILLENIUM (by WATERS) according to the method of the narrow standard.

The quantity of PMMA mixed in is in the range of 0.1–4 wt % relative to the polyester which functions as a fiber-forming polymer. Preferred is the range from 0.2 to 3 wt %; especially preferred is a PMMA quantity in the range of 0.3 to 2 wt %.

The mixing of the polymethyl methacrylate as an additive to PET can, for example, be done through the so-called "melt conditioning" method for continuous modification of polymer melting (DE 40 39 857 C2). The content of DE 40 39 857 C2 is herewith incorporated by reference entirely in the latter application. A part of the molten mass, which can come directly out of polycondensation or from a remelting, is diverted from the main melt stream. This partial stream is fed in a side-stream extruder and there it is mixed with the additive in form of granulates, powders, or preferably pearls, and then dispersed. The dispersed and mixed molten concentrate is then directed back into the main melt line and there diluted to the final concentration.

In addition to the "melt conditioning" method discussed above, it is possible, for example, to generate a pure additive molten mass by means of a melt extruder, and to inject it into the main melt current. A corresponding arrangement of mixing elements then provides for a homogenization and inclusion of the additive in the fiber-forming matrix polymer (such as polyethylene terephthalate).

In the case where PET granulate is used as the starting material and is melted in a spin extruder, it is further possible to dose the PMMA directly into the spin extruder as an additive (in granulate, powder or pearl form) to the PET granulate. There the additive is dispersed in the polyethylene terephthalate, and then, the molten mixture is spun. As in the "melt conditioning" method, the starting form of the PMMA as pearls is also preferred in this mixing variant, because this favors a fine distribution in the molten PET mass, and in addition, the commercial PMMA products generally can also be easily obtained in this form. These pearls instead of granules are in the case of DEGALAN® G8E small spheres with a diameter of approximately 0.3 mm, occasionally they are also called grit.

The additive can be added both as a pure substance and in master batch form. In addition, other added substances or additives can also be kneaded in and spun as well. The polyethylene terephthalate itself can also contain the customary additives such as delustering agents (titanium dioxide), stabilizers, catalysts, etc. In connection with this application, "polyethylene terephthalate" (PET) or "polyester" is understood to mean the polyesters that contain at least 80% polyethylene terephthalate units and a maximum 20% units that come from a diol other than ethylene glycol, such as diethylene glycol, tetramethylene glycol, or a dicarboxylic acid other than terephthalic acid, for example, isophthalic acid, hexahydroterephthalic acid, dibenzoic acid.

Polyethylene terephthalate can optionally be modified with small molar quantities of a branching agent with 3–4 functional alcohol or acid groups, such as trimethylpropane, trimethyloletane, pentaerythrite, glycerin, trimesic acid, trimellitic acid, or pyromellitic acid.

The starting polyester can, however, also contain known additives in order to modify the capability of the coloring, such as sodium-3,5-dicarboxybenzol sulfonate.

In the melt line, for example, there is the possibility of using other dynamic and/or static mixers. For this, dynamic and/or static mixers can also be placed directly in front of the spin pack.

In one embodiment of the invention, the ready-to-use, dispersed, melt mixture that can be produced by any one of the intermixing variants described is not first spun into fibers, but granulated. This high performance granulate can later be processed on conventional spinning machines with a melting extruder, and spun into fibers. In the process, the secondary processor, for example, a customer of the granulate manufacturer, has all the advantages of the polyester modified according to the invention without having to equip his conventional spinning machine with expensive metering and mixing facilities and without having to buy a separate additive. Thus, the entire handling is as simple for the secondary processor as with normal PET granulate.

FIGS. 1, 2, and 3 show REM cross-sectional images of a melt fiber according to the invention in the matrix polymer (PET), that were taken under the die plate in the unoriented state. In particular, FIG. 3 ("rods," cut sideways) shows the axial inclusion of the PMMA additive (drafting in the fiber axis).

The invention will now be explained in greater detail on the basis of the following examples, without being limited to them.

The customary spinning machines known to the art were used, as described, for example, in Ullmann's Encyclopedia of Industrial Chemistry, 5th Ed., Vol. A10, Fibers, 3. General Production Technology, p. 535, FIG. 26.

EXAMPLE

The results of the tests listed in Table I were obtained on a 6-end production spinning apparatus. Table I shows results from spin tests with a take-up speed (Vwick) of 4,950 m/min. The spinning temperature was 285° C. whereby the range of 280 to 295° C. is preferred. For the cooling of the fibers, a passive cooling was used, as described, for example, in DE 197 16 394 C1. After running through the cooling line, the yam was guided over a cold godet-duo and then taken up. The godet speed, that is, the actional spinning speed for all variants, except for the blank sample "Blank-2," was 5000 m/min. For the variant "Blank-2," (conventional, without additive), the godet speed was 3225 m/min. For the mixing-in of the additive, the "melt conditioning" method (DE 40 39 857 C2) was used, which is customarily used for melt modification in continuous polyester polycondensation installations with directly connected spinning machine. To produce the yam, a familiar dulled polyethylene terephthalate, customarily used for textile purposes, of EMS-CHEMIE AG with the name GRILENE® M764 was used. The additive used was a polymethyl methacrylate of the DEGUSSA Co. with the name DEGALAN® G8E with a molecular weight of 126,580 g/mol (weight average). The concentration ran to 0.65–0.90 wt %. The mean lateral diameters of the polymethyl methacrylate inclusions (see FIGS. 1, 2, 3) were less than 400 nm.

The spinning behavior was very good. Only full spools were produced.

Table II shows the textile data of the textured yam. The quality data achieved with the modified polyester correspond to that of good, conventionally produced textured yam. However, the profit lies in the enormous increase of productivity in the spinning machine when it is considered that normal POY yam is only spun at approximately 3200 m/min.

TABLE I

| | 6-fiber position of a production installation | | | | |
|---|---|---|---|---|---|
| Type of Additive | G8E | G8E | G8E | Blank-1 | Blank-2 |
| Quantity % | 0.65 | 0.76 | 0.90 | — | — |
| RD % | 120.6 | 126.6 | 134.1 | 64.7 | 121.8 |
| RF (cN/dtex) | 2.4 | 2.24 | 2.01 | 3.07 | 2.31 |
| Titer (dtex) | 129.7 | 131.2 | 129.7 | 124.9 | 125.3 |
| Vwick (m/min) = take up speed | 4950 | 4950 | 4950 | 4950 | 3170 |
| Spinning Behavior | Very good | Very good | Very good | Good | Very good |
| Diameter (nm)* Mean lateral "rod diameter" under spinneret | Less than 400 | Less than 400 | | | |

TABLE II

| | Draw texturing | | |
|---|---|---|---|
| Type of Additive | G8E | G8E | Blank-2 |
| Quantity % | 0.65 | 0.76 | — |
| RD | 21.3 | 21.7 | 21.4 |
| RF (cN/dtex) | 4.08 | 4.06 | 4.1 |
| Titer (dtex) | 80.7 | 77.1 | 75.8 |
| Vtex (m/min) = take up speed of the draw texturing process | 800 | 800 | 800 |
| Drawing Ratio | 1.68 | 1.74 | 1.695 |
| Running Behavior | Very good | Very good | Very good |

The abbreviations in Tables I and II have the following meanings:

G8E=PMMA-type of the DEGUSSA Co. with the trade name DEGALAN® as additive to the PET in the specified quantity.

Blank-1 =Blank variant (comparative example) without addition of the additive, only PET-type Grilene® M764 of EMS-CHEMIE AG (relative viscosity=1.64 measured 1% in mcresol)

Blank-2=like Blank-1, but with lower spinning and take-up rate

RD=elongation at break

RF=tensile strength at break

Although the foregoing description of the preferred embodiment of the invention has shown, described and pointed out the fundamental novel features of the invention, it will be understood that various omissions, substitutions, and changes in the form of the detail of the polymer mixtures, the fibers, and the method for producing the fibers illustrated as well as the uses thereof, may be made by those skilled in the art, without departing from the spirit of the present invention. Consequently, the scope of the present invention should not be limited to the foregoing discussions, but should be defined by the appended claims.

What is claimed is:

1. Fibers consisting essentially of polyethylene terephthalate as a fiber-forming polymer, characterized in that the fibers contain 0.1–4 wt %, relative to the fiber-forming polymer, polymethyl methacrylate with a weight average molecular weight of about 20,000 to 200,000 g/mol, predominantly in the form of rod shaped inclusions, measured in a still-unoriented melt fiber free fall yarn extruded from a spinneret, a cross-section of the rod shaped inclusions of the polymethyl methacrylate is less than 800 nm, and the spinning speed of the spinning fiber in the production of the fibers is up to 8000 m/min.

2. Fibers according to claim 1, wherein the rod shaped polymethyl methacrylate inclusions have a mean lateral diameter of less than 600 nm.

3. Fibers according to claim 1, wherein the rod shaped polymethyl methacrylate inclusions have a mean lateral diameter of less than 400 nm.

4. Fibers according to claim 1, wherein the polymethyl methacrylate has a weight-averaged molecular weight of about 50,000 to 160,000 g/mol.

5. Fibers according to claim 1, wherein the polymethyl methacrylate has a weight-averaged molecular weight of about 80,000 to 140,000 g/mol.

6. Fibers according to claim 1, wherein the fibers contain 0.2–3 wt % polymethyl methacrylate.

7. Fibers according to claim 1, wherein the fibers contain 0.3–2 wt % polymethyl methacrylate.

* * * * *